US010796868B2

(12) United States Patent
Yu et al.

(10) Patent No.: US 10,796,868 B2
(45) Date of Patent: Oct. 6, 2020

(54) THOMSON COIL INTEGRATED MOVING CONTACT IN VACUUM INTERRUPTER

(71) Applicant: Eaton Intelligent Power Limited, Dublin (IE)

(72) Inventors: Li Yu, Bridgeville, PA (US); Hongbin Wang, Novi, MI (US); Robert W. Mueller, Aliquippa, PA (US); David Rohn, Venetia, PA (US); Andrew A. Rockhill, Waukesha, WI (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 128 days.

(21) Appl. No.: 16/271,927

(22) Filed: Feb. 11, 2019

(65) Prior Publication Data

US 2020/0258704 A1 Aug. 13, 2020

(51) Int. Cl.

| | |
|---|---|
| ***H01H 33/66*** | (2006.01) |
| ***H01H 33/666*** | (2006.01) |
| ***H01H 33/662*** | (2006.01) |
| *H01H 33/664* | (2006.01) |

(52) U.S. Cl.

CPC .. *H01H 33/6662* (2013.01); *H01H 33/66207* (2013.01); *H01H 33/664* (2013.01); *H01H 33/666* (2013.01)

(58) Field of Classification Search

CPC ..... H01H 33/66; H01H 33/6662

See application file for complete search history.

(56) References Cited

U.S. PATENT DOCUMENTS

| | | | |
|---|---|---|---|
| 7,902,480 | B2 | 3/2011 | Tsuchiya et al. |
| 8,471,166 | B1 | 6/2013 | Glaser |
| 8,658,933 | B2 | 2/2014 | Gentsch |
| 9,741,513 | B2 | 8/2017 | Schmitz et al. |
| 9,911,562 | B2 | 3/2018 | Bissal et al. |
| 2015/0332880 | A1 | 11/2015 | Falkingham |
| 2018/0005784 | A1 | 1/2018 | Nagatake et al. |

*Primary Examiner* — Ramon M Barrera

(74) *Attorney, Agent, or Firm* — Eckert Seamans Cherin & Mellott, LLC

(57) ABSTRACT

A vacuum chamber contact assembly includes a vacuum housing assembly, a conductor assembly, and an operating mechanism. The vacuum housing assembly defines a sealed enclosed space. The conductor assembly includes a first stationary conductor assembly, a second stationary conductor assembly, and a movable conductor assembly. The operating mechanism includes a number of stationary components, a number of movable components and an actuator/latch assembly. The movable conductor assembly and the operating mechanism movable components are disposed entirely within the vacuum housing assembly enclosed space. The actuator/latch assembly includes an open, first latch unit and a close, second latch unit. The actuator/latch assembly is structured to maintain the movable conductor assembly in both the first position and the second position.

20 Claims, 4 Drawing Sheets

THOMSON COIL INTEGRATED MOVING CONTACT IN VACUUM INTERRUPTER

BACKGROUND OF THE INVENTION

Field of the Invention

The disclosed and claimed concept relates to vacuum circuit interrupters and, more specifically to a vacuum chamber contact assembly for a vacuum circuit interrupter.

Background Information

Circuit breaker assemblies provide protection for electrical systems from electrical fault conditions such as current overloads, short circuits, and low level voltage conditions. Typically, circuit breakers include a spring-powered operating mechanism which opens electrical contacts to interrupt the current through the conductors in an electrical system in response to abnormal conditions. In particular, vacuum circuit interrupters include separable main contacts disposed within an insulated and hermetically sealed vacuum housing. That is, the main contacts typically include a fixed/stationary contact and a movable contact. The movable contact moves between an open, first position, wherein the movable contact is spaced from, and not in electrical communication with, the stationary contact, and, a closed, second position, wherein the movable contact is coupled/directly coupled to, and is in electrical communication with, the fixed contact. Both the stationary contact and the movable contact are further coupled to, and are in electrical communication with, line and load conductors disposed outside the vacuum housing.

The contacts are part of a conductor assembly that also includes an elongated stem. Generally, the conductor assembly with the stationary contact is fixed to the vacuum housing. The other conductor assembly is moveable. That is, both the stem and the movable contact are movably coupled to the vacuum housing. The moveable conductor assembly stem extends through the vacuum housing and an operating mechanism is operatively coupled to the exposed portion of the stem. To accommodate the moving stem and to maintain the vacuum in the vacuum chamber, the stem is sealingly coupled to a bellows.

That is, typically, the vacuum chamber includes a sidewall and two ends defining an enclosed space. The sidewall is often generally cylindrical. The end through which the fixed conductor assembly stem extends is sealingly coupled, e.g., welded/brazed, to the vacuum housing and to the fixed conductor assembly stem. As a seal disposed about a sliding stem is insufficient to maintain a vacuum in the vacuum housing, a bellows is welded/brazed to both the vacuum housing and the stem of the movable conductor assembly. This is a disadvantage as the bellows is prone to wear and tear and may rupture leading to leakage into the vacuum chamber.

To avoid the use of a bellows, some vacuum circuit breakers have moved the operating mechanism to a location within the vacuum housing. For example, U.S. Pat. Pub. 2015/0332880 discloses a vacuum circuit breaker wherein the moveable conductor assembly stem is, essentially, the actuator of a solenoid. The solenoid coil is disposed either outside or inside the vacuum housing and, when energized, causes the moveable conductor assembly stem to move between the first and second positions. This embodiment also has problems.

For example, in an embodiment wherein the operating mechanism is disposed outside the vacuum housing assembly, the operating mechanism may become contaminated leading to damage, or, may simply be damaged by external forces/objects. This is a problem. In an embodiment wherein the movable conductor assembly stem does not extend through the vacuum housing, electricity is passed through a wire or a slider assembly such as, but not limited to, a telescoping construct. That is, for example, a braided wire is coupled to, and in electrical communication with, the movable conductor assembly stem. A braided wire is required so as to be sufficiently flexible and durable. The braided wire further extends through the vacuum housing and is coupled to a line/load conductor. This is a disadvantage as the braided wire is not as robust as a conductor assembly stem and is subject to wear and tear. Further, a braided wire has a large surface area, i.e., the combined surface area of all the wires/filaments in the braided wire, which is larger than the surface area of the vacuum chamber housing. This is a disadvantage in that, when a vacuum is drawn in the vacuum chamber, residual gas molecules attach to the surface of the braided wire. The residual gas must be removed or it will be released during the use of the vacuum interrupter and degrade the performance of the vacuum interrupter. Removal of the residual gas molecules attached to the surface of the braided wire requires heating the vacuum chamber and braided wire to 600° C.-800° C. for a period of time. The larger the surface area of the braided wire, the longer the heat treatment. Thus, use of a braided wire adds to the time and cost of such a vacuum chamber. This is a disadvantage.

A slider assembly, typically, includes a spring. As is known, the process of producing a vacuum chamber includes heating the chamber up to 600° C. The spring can be damaged during the heating process and/or otherwise wear out. The vacuum chamber must be opened to repair any damage to a slider assembly spring.

Further, the operating mechanism in this configuration does not latch the movable conductor assembly in either the first or second positions. That is, an element of the operating mechanism, i.e., the solenoid, is always energized so as to maintain the movable conductor assembly in the desired position. As used herein, "energized" means a component having current flowing therethrough. Further, in this configuration, the movable conductor assembly moves at a high, or "full" speed and contacts the vacuum housing. This causes wear and tear and can damage or puncture the vacuum housing assembly. These are problems.

There is, therefore, a need for a vacuum chamber contact assembly wherein the operating mechanism is disposed within the vacuum housing assembly. There is a further need for a vacuum chamber contact assembly for a vacuum circuit interrupter that does not include a conductor wire, or similar construct, in the vacuum chamber. There is a further need for a vacuum chamber contact assembly that does not require an element of the operating mechanism to be energized at all times. There is a further need for a vacuum chamber contact assembly wherein the motion of the movable contact assembly does not cause a full speed impact of the vacuum housing assembly.

SUMMARY OF THE INVENTION

These needs, and others, are met by at least one embodiment of the disclosed and claimed concept which provides a vacuum chamber contact assembly including a vacuum housing assembly, a conductor assembly, and an operating mechanism. The vacuum housing assembly defines a sealed enclosed space. The conductor assembly includes a first stationary conductor assembly, a second stationary conductor assembly, and a movable conductor assembly. The operating mechanism includes a number of stationary components, a number of movable components and an actuator/latch assembly. The movable conductor assembly and the operating mechanism movable components are disposed entirely within the vacuum housing assembly enclosed space. The actuator/latch assembly includes an open, first latch unit and a close, second latch unit. The movable conductor assembly moves between an open, first position, wherein the movable conductor assembly is spaced from, and is not in electrical communication with the first stationary conductor assembly and the second stationary conductor assembly, and, a second position, wherein the movable conductor assembly is coupled to, and is in electrical communication with the first stationary conductor assembly and the second stationary conductor assembly. The actuator/latch assembly is structured to maintain the movable conductor assembly in both the first position and the second position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
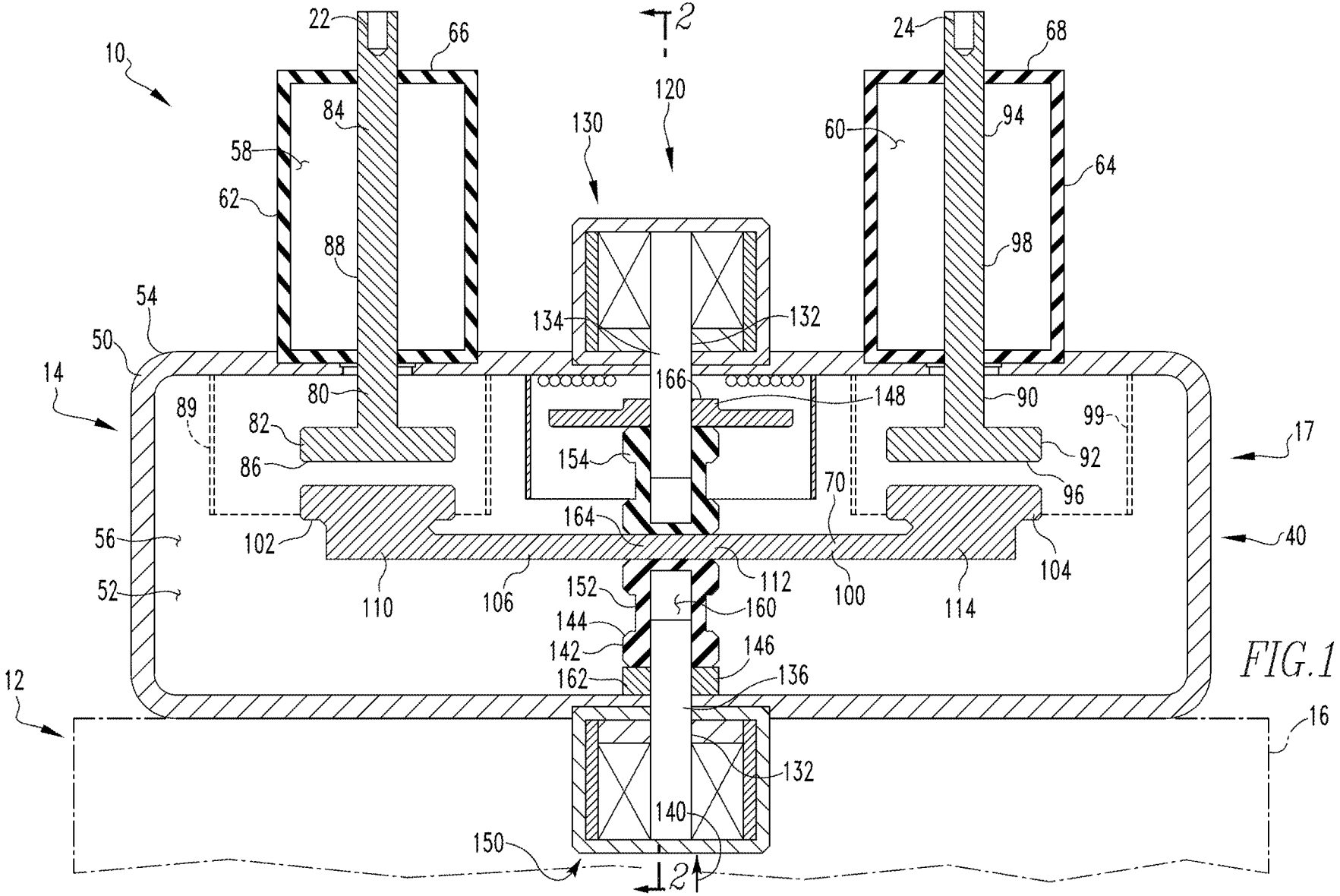
FIG. 1 is a top cross-sectional view of the vacuum chamber contact assembly with the movable contact assembly in the first position.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of"a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hubcaps. While all the elements are coupled as part of the automobile, it is understood that each hubcap is "associated" with a specific tire.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut or threaded bore.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "temporarily disposed" means that a first element(s) or assembly (ies) is resting on a second element (s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours. With regard to elements/assemblies that are movable or configurable, "corresponding" means that when elements/assemblies are related and that as one element/assembly is moved/reconfigured, then the other element/assembly is also moved/reconfigured in a predetermined manner. For example, a lever including a central fulcrum and elongated board, i.e., a "see-saw" or "teeter-totter," the board has a first end and a second end. When the board first end is in a raised position, the board second end is in a lowered position. When the board first end is moved to a lowered position, the board second end moves to a "corresponding" raised position. Alternately, a cam shaft in an engine has a first lobe operatively coupled to a first piston. When the first lobe moves to its upward position, the first piston moves to a "corresponding" upper position, and, when the first lobe moves to a lower position, the first piston, moves to a "corresponding" lower position.

As used herein, a "path of travel" or "path," when used in association with an element that moves, includes the space an element moves through when in motion. As such, any element that moves inherently has a "path of travel" or "path." Further, a "path of travel" or "path" relates to a motion of one identifiable construct as a whole relative to another object. For example, assuming a perfectly smooth road, a rotating wheel (an identifiable construct) on an automobile generally does not move relative to the body (another object) of the automobile. That is, the wheel, as a whole, does not change its position relative to, for example, the adjacent fender. Thus, a rotating wheel does not have a "path of travel" or "path" relative to the body of the automobile. Conversely, the air inlet valve on that wheel (an identifiable construct) does have a "path of travel" or "path" relative to the body of the automobile. That is, while the wheel rotates and is in motion, the air inlet valve, as a whole, moves relative to the body of the automobile.

As used herein, the statement that two or more parts or components "engage" one another means that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "temporarily coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality). That is, for example, the phrase "a number of elements" means one element or a plurality of elements. It is specifically noted that the term "a 'number' of [X]" includes a single [X].

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, "in electronic communication" is used in reference to communicating a signal via an electromagnetic wave or signal. "In electronic communication" includes both hardline and wireless forms of communication; thus, for example, a "data transfer" or "communication method" via a component "in electronic communication" with another component means that data is transferred from one computer to another computer (or from one processing assembly to another processing assembly) by physical connections such as USB, Ethernet connections or remotely such as NFC, blue tooth, etc. and should not be limited to any specific device.

As used herein, "in electric communication" means that a current passes, or can pass, between the identified elements. Being "in electric communication" is further dependent upon an element's position or configuration. For example, in a circuit breaker, a movable contact is "in electric communication" with the fixed contact when the contacts are in a closed position. The same movable contact is not "in electric communication" with the fixed contact when the contacts are in the open position.

As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center. That is, generally, for a cylindrical soup can, the "radial side/surface" is the generally circular sidewall and the "axial side(s)/surface(s)" are the top and bottom of the soup can. Further, as used herein, "radially extending" means extending in a radial direction or along a radial line. That is, for example, a "radially extending" line extends from the center of the circle or cylinder toward the radial side/surface. Further, as used herein, "axially extending" means extending in the axial direction or along an axial line. That is, for example, an "axially extending" line extends from the bottom of a cylinder toward the top of the cylinder and substantially parallel to, or along, a central longitudinal axis of the cylinder.

As used herein. "generally curvilinear" includes elements having multiple curved portions, combinations of curved portions and planar portions, and a plurality of linear/planar portions or segments disposed at angles relative to each other thereby forming a curve.

As used herein, an "elongated" element inherently includes a longitudinal axis and/or longitudinal line extending in the direction of the elongation.

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, "magnetic" means either a permanent magnet/electromagnet and/or a ferromagnetic construct associated with a magnet. Thus, for example, a plurality of "magnetic" members may include all permanent magnets or a combination of at least one permanent magnet and other ferromagnetic members.

As used herein, "at" means on and/or near relevant to the term being modified as would be understood by one of ordinary skill in the art.

Figure 2:
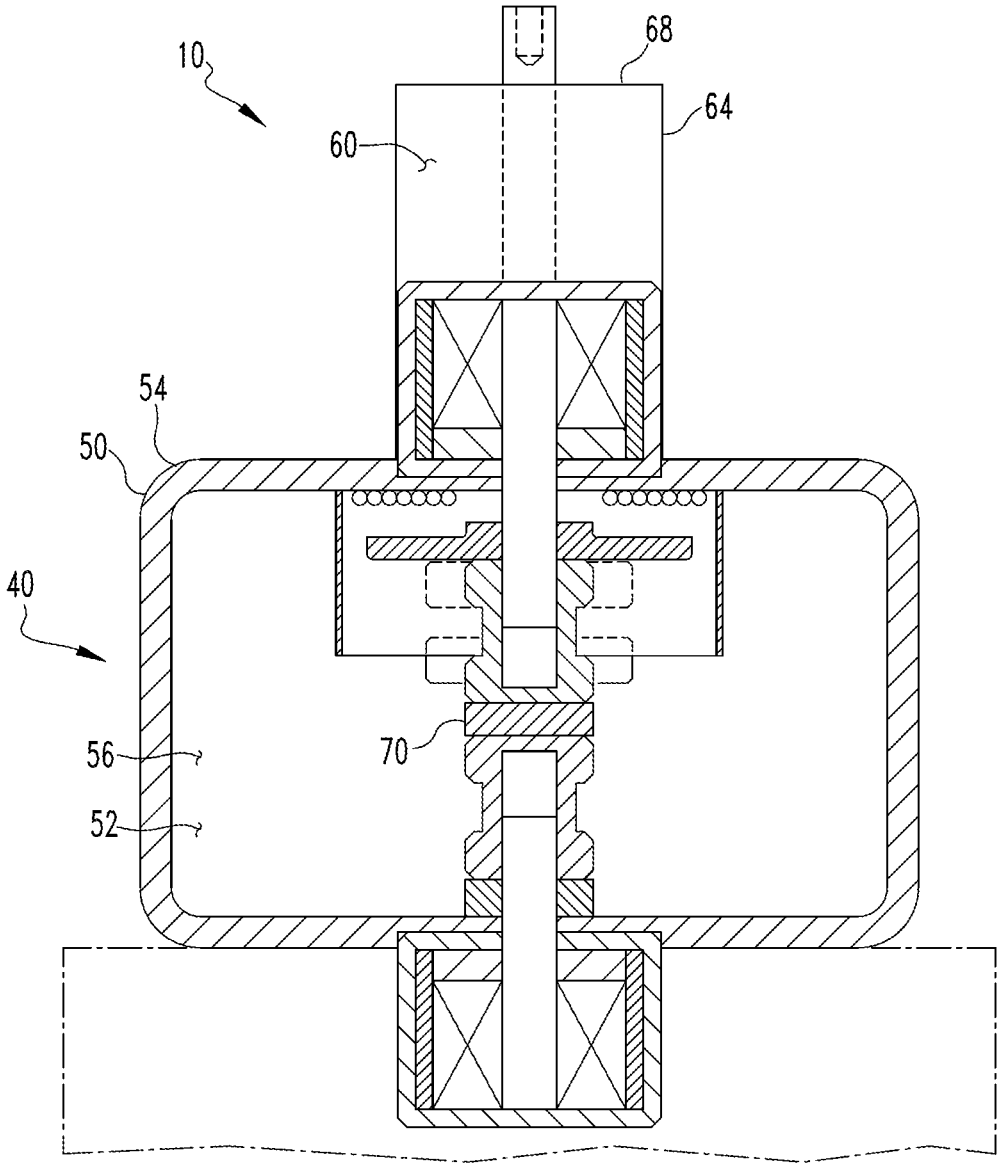
FIG. 2 is a side cross-sectional view of the vacuum chamber contact assembly with the movable contact assembly in the first position.
Figure 3:
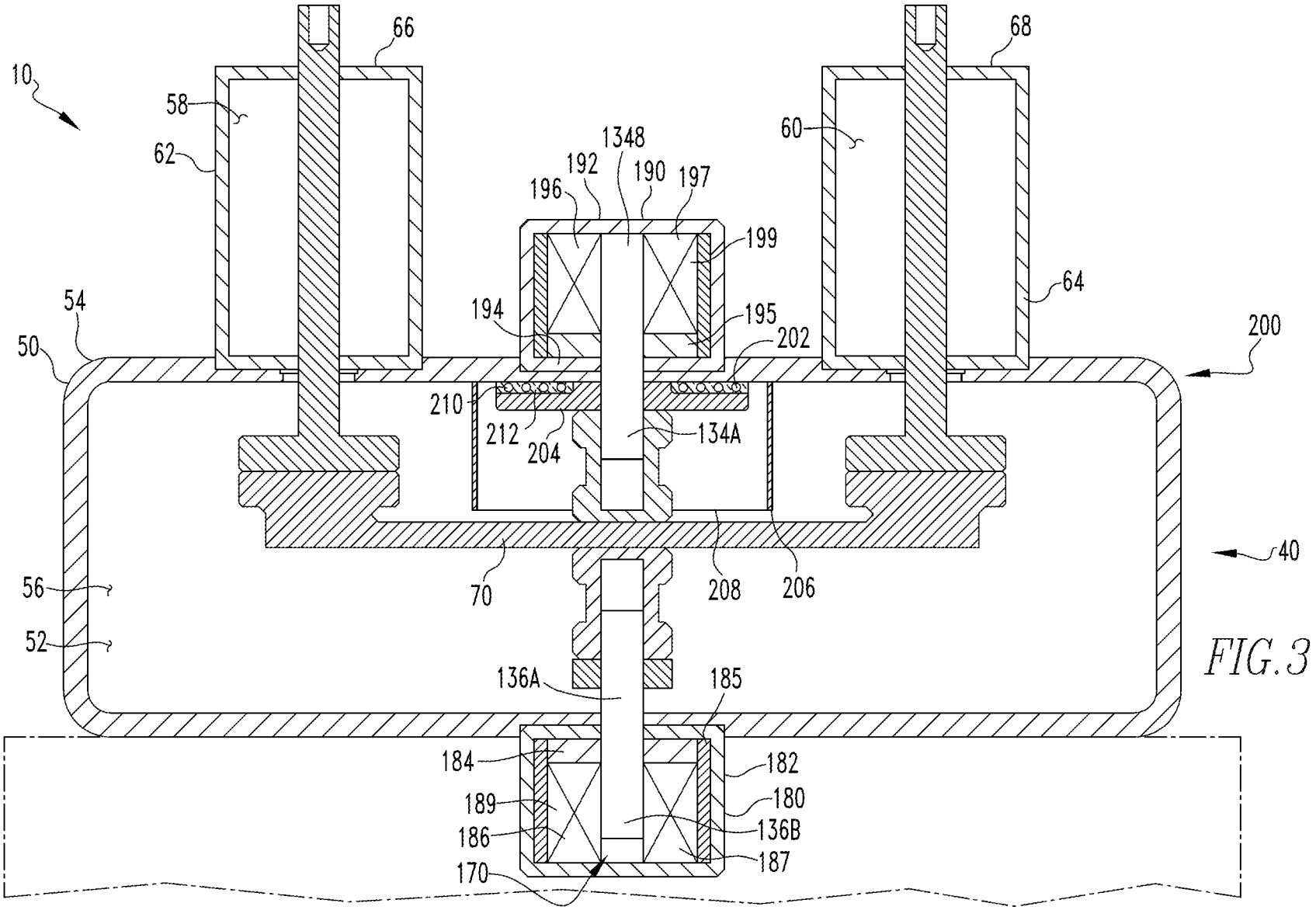
FIG. 3 is a top cross-sectional view of the vacuum chamber contact assembly with the movable contact assembly in the second position.
Figure 4:
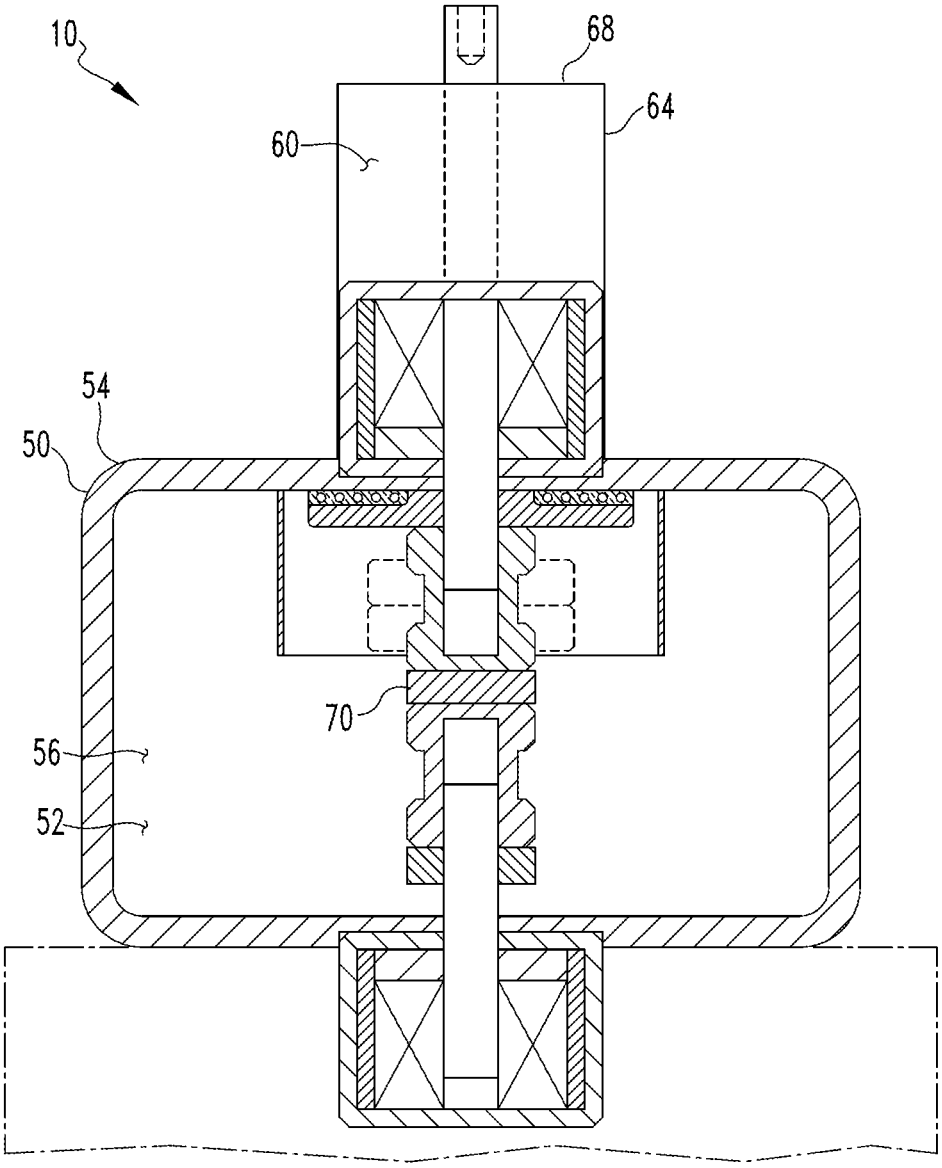
FIG. 4 is a side cross-sectional view of the vacuum chamber contact assembly with the movable contact assembly in the second position.

Referring to FIGS. 1-4, there is illustrated schematically a vacuum circuit breaker 10 incorporating a vacuum chamber contact assembly 40. As is known, the vacuum circuit breaker 10 may be a single pole or multi-pole vacuum circuit breaker 10. Hereinafter, and as an exemplary embodiment, only a single pole will be discussed. It is, however, understood that the claims are not limited to an embodiment having only a single pole. Generally, the vacuum circuit breaker 10, in an exemplary embodiment, includes a low voltage portion 12 (shown schematically) and a high voltage portion 14. The low voltage portion 12 includes a housing assembly 16 structured to include a control device (not shown) such as, but not limited to, a circuit breaker assembly and/or a control unit for manually operating the vacuum circuit breaker 10. The control unit is structured to change the state of the contacts 82, 92, 102, 104 (discussed below) to either an open or closed configuration. The control device is structured to actuate the operating mechanism 17.

Generally, a line is coupled to, and is in electrical communication with, a first terminal 22 and a load is coupled to, and is in electrical communication with, a second terminal 24. There are instances, however, such as when a line enters through a floor (not shown), wherein the line (1) is coupled to, and is in electrical communication with, the lower, second terminal 24. Thus, it is understood that the location of the line/load depends upon the configuration of each vacuum circuit breaker 10. In the example shown, it is assumed that the line is coupled to, and is in electrical communication with, the first terminal 22 and the load is coupled to, and is in electrical communication with, the second terminal 24.

The vacuum chamber contact assembly 40 is coupled, directly coupled, or fixed to the housing assembly 16. The vacuum chamber contact assembly 40 is structured to be in one of a first configuration, wherein the first terminal 22 and the second terminal 24 are not in electrical communication, and, a second configuration, wherein the first terminal 22 and the second terminal 24 are in electrical communication. The vacuum chamber contact assembly 40 is structured to receive a command to switch configurations from either a control unit or a trip unit (neither shown). The vacuum chamber contact assembly 40 includes a vacuum housing assembly 50, a conductor assembly 70, and an operating mechanism 120. The vacuum housing assembly 50 defines a sealed enclosed space 52. As used herein, a "sealed enclosed space" means a space that is structured to, and does, maintain a vacuum as associated with vacuum circuit breakers, as is known in the art. In an exemplary embodiment, the vacuum housing assembly 50 includes a body 54 defining a contact assembly chamber 56, a first stem chamber 58, and a second stem chamber 60. The contact assembly chamber 56 is sized to accommodate a movable conductor assembly 100 and an operating mechanism 120, discussed below. The contact assembly chamber 56, as shown, includes two stem openings as well as a first rail passage and a second rail passage (none numbered). Otherwise, the vacuum housing assembly body 54 does not include any openings. As shown, and in an exemplary embodiment, the first stem chamber 58 and the second stem chamber 60 are each defined by hollow, generally cylindrical, ceramic sidewalls 62, 64 and an end cap 66, 68. It is understood that the end caps 66, 68 are sealingly coupled to the ceramic sidewalls 62, 64. Further, the ceramic sidewalls 62, 64 are sealingly coupled to the vacuum housing assembly body 54 at the stem openings. In an alternate embodiment, the first stem chamber 58 and the second stem chamber 60 are each defined by a steel enclosure.

The conductor assembly 70 includes a first stationary conductor assembly 80, a second stationary conductor assembly 90, and a movable conductor assembly 100. The first stationary conductor assembly 80 and the second conductor assembly 90 each include a stationary contact 82, 92 and a stem 84, 94. As used herein, where there are multiple similar assemblies with similar components, and where the different assemblies are distinguished by terms such as "first" and "second," the components of the assemblies are subsequently identified by the term "first" and "second" as well as the component name but without identifying the full assembly. Thus, for example, the "first stationary conductor assembly stationary contact 82" is reduced to the "first stationary contact 82."

In an exemplary embodiment, each of the first and second stationary contacts 82, 92 includes a generally short cylindrical, or disk-like, body 86, 96. Each of the first and second stems 84, 94 includes an elongated cylindrical body 88, 98. The radius of the first and second stationary contact body 86, 96 have a greater radius than the associated first and second stem body 88, 98. The first stationary contact 82 is, in an exemplary embodiment, unitary with the first stem 84. Similarly, the second stationary contact 92 is unitary with the second stem 94. The first and second stationary contacts 82, 92 are disposed at one end of the associated first and second stem body 88, 98. The distal end of the first and second stem bodies 88, 98, i.e., the end opposite the contact 82, 92, extends through a stem chamber end cap 66, 68, as described below. The first stationary conductor assembly 80 and the second conductor assembly 90 are made from a conductive material such as, but not limited to, copper.

The movable conductor assembly 100 includes a first movable contact 102, a second movable contact 104, and a crossbar 106. The first movable contact 102, the second movable contact 104, and the crossbar 106 are, in an exemplary embodiment, unitary and made from a conductive material. The crossbar 106 includes an elongated body with a first end 110, a medial portion 112, and a second end 114. The first movable contact 102 is disposed at the crossbar first end 110. The second movable contact 104 is disposed at the crossbar second end 114.

The operating mechanism 120 is structured to, and does, move the movable conductor assembly 100 between a first position, wherein the movable conductor assembly 100 is spaced from (or is not coupled to), and is not in electrical communication with, the first stationary conductor assembly 80 and/or the second stationary conductor assembly 90. Stated alternately, the operating mechanism 120 is structured to, and does, move the first and second movable contacts 102, 104 between a first position, wherein the first and second movable contacts 102, 104 are spaced from, and are not in electrical communication with, the first stationary conductor assembly 80 and/or the second stationary conductor assembly 90, and, a second position, wherein the first and second movable contacts 102, 104 are coupled to, and are in electrical communication with, the first stationary conductor assembly 80 and/or the second stationary conductor assembly 90. Further, the operating mechanism 120 is structured to, and does, maintain the movable conductor assembly 100 in both the first position and the second position.

In an exemplary embodiment, the operating mechanism 120 includes a number of stationary components 130, a number of movable components 140 and an actuator/latch assembly 170. The division between stationary components 130 and movable components 140 is noted because the movable components 140 are disposed entirely within the vacuum housing assembly enclosed space 52. This configuration solves the problem(s) noted above. It is further noted that some elements are identified as being part of one of the groups as well as the actuator/latch assembly 170. Further, as the elements of these groups/assembly are not always disposed close to each other, the following is an exemplary list of elements in the identified groups and/or the actuator/latch assembly 170.

| Operating Mechanism Stationary Components | Operating Mechanism Movable Components | Actuator/Latch Assembly |
|---|---|---|
| Rail 132 | Traveler assembly 142 | First latch unit 180 |
| First latch unit 180 | Traveler assembly body assembly 144 | Second latch unit 190 |
| Second latch unit 190 | Traveler assembly first armature 146 | Traveler assembly body assembly 144 |
| Thomson coil assembly 200 | Traveler assembly second armature 148 | Traveler assembly first armature 146 |
| | | Traveler assembly second armature 148 |

These elements are discussed in detail below.

The operating mechanism stationary components 130 include a rail 132 and selected elements of the actuator/latch assembly 170. The rail 132 has a non-circular cross-section (taken in a plane generally perpendicular to the longitudinal axis of the rail 132). In an exemplary embodiment, the rail 132 is bifurcated and includes an elongated first portion 134 and an elongated second portion 136. Further, each rail portion 134, 136 includes an interior segment 134A, 136A and an exterior segment 134B, 136B. In an exemplary embodiment, the rail 132 is sealingly coupled to the vacuum housing assembly 50. In an exemplary embodiment, the rail 132 is brazed to the vacuum housing assembly 50. Thus, the rail interior segments 134A, 136A are disposed in the vacuum housing assembly enclosed space 52 and the rail exterior segments 134B, 136B are disposed outside of the housing assembly 50. It is noted that the non-circular shape of the rail 132 prevents the traveler assembly 142 from rotating about the rail 132. This ensures that the first and second movable contacts 102, 104 are always aligned with stationary contacts 82, 92. Further, the rail 132 is structured to, and does, conduct the magnetic flux from mechanism in the air to the first and second armature 146, 148 in the vacuum housing assembly 50. That is, but for the rail 132 extending through the vacuum housing assembly 50, there would be a large energy loss if magnetic flux passed through a solid vacuum housing assembly 50. Further, the rail first and second portions 134, 136 are disposed generally opposite of each other with the longitudinal axes of the rail first and second portions 134, 136 substantially aligned. In an exemplary embodiment, the rail 132 is disposed in the contact assembly chamber 56.

The operating mechanism movable components 140 are disposed entirely within the vacuum housing assembly enclosed space 52. The operating mechanism movable components 140 include a traveler assembly 142. The traveler assembly 142 is movably disposed on the rail 132, and, more specifically, on the interior segments 134A. 136A, and is structured to, and does, travel between a first position and a second position. The traveler assembly 142 includes a body assembly 144, a first armature 146, and a second armature 148. As shown, the traveler assembly body assembly 144 includes a bifurcated body 150 having a first portion 152 and a second portion 154. In an exemplary embodiment, the traveler body first portion 152 and second portion 154 are made from a non-conductive/insulating material. The traveler body first portion 152 and second portion 154 are each generally cup-shaped, i.e., including a base and a depending sidewall defining a passage (none numbered). While not "unitary," as defined above, the traveler assembly body assembly 144 is hereinafter identified as a single unit. The traveler assembly body assembly 144 includes a first end 162, a medial portion 164 and a second end 166. Further, the traveler assembly body assembly 144 defines a passage 160 (which is the bifurcated passage defined by the traveler body first portion 152 and second portion 154). The traveler assembly body assembly passage 160 is non-circular and is sized and shaped to correspond to the cross-sectional shape/contour of the rail 132. The traveler body first portion 152 defines the traveler assembly body assembly first end 162. The traveler body second portion 154 defines the traveler assembly body assembly second end 166. The "traveler assembly body assembly medial portion 164" is defined herein as the space between the traveler body first portion 152 and second portion 154. In an exemplary embodiment, the traveler body first portion 152 and second portion 154 are made from ceramic.

The first armature 146 and the second armature 148 are made from a magnetic material. The first armature 146 is coupled, directly coupled, or fixed to the distal surface of the traveler assembly body assembly first end 162. The second armature 148 is coupled, directly coupled, or fixed to the distal surface of the traveler assembly body assembly second end 166.

The actuator/latch assembly 170 is structured to, and does, maintain the movable conductor assembly 100 in both the first position and the second position. The actuator/latch assembly 170 includes an open, first latch unit 180 a close, second latch unit 190, and a Thomson coil assembly 200. The first latch unit 180 is structured to, and does, maintain the movable conductor assembly 100 in the first position. The second latch unit 190 is structured to, and does, maintain the movable conductor assembly 100 in the second position. The Thomson coil assembly 200 is structured to, and does, move the movable conductor assembly 100 from the second position to the first position.

The components of the first latch unit 180 and the second latch unit 190 are substantially similar and only the first latch unit 180 is described in detail. The second latch unit 190 includes similar components which, as used herein, are identified by similar reference number +10. That is, for example, the first latch unit 180 includes a permanent magnet 184. Thus, the second latch unit 190 also includes a permanent magnet that is identified by reference number 194. The first latch unit 180 and the second latch unit 190 are also identified herein as operating mechanism stationary components 130.

The first latch unit 180 includes a housing 182, a permanent magnet 184, and a driving coil 186. In an exemplary embodiment, and generally, the first latch unit housing 182, the first latch unit permanent magnet 184 and the first latch unit driving coil 186 are generally toroid. That is, these elements are each generally shaped as a hollow cylinder or disk. In an exemplary embodiment, as shown, the first latch unit 180 is disposed substantially on, or entirely on, the outer surface of the vacuum housing assembly 50. The first latch unit housing 182 is disposed about the first rail passage. That is, the passage of the first latch unit housing 182 is substantially aligned with, and is sized to correspond to, the first rail passage. The first latch unit permanent magnet 184 is disposed within the first latch unit housing 182 and immediately adjacent the vacuum housing assembly 50. The first latch unit driving coil 186 is disposed within the first latch unit housing 182 and immediately adjacent first latch unit permanent magnet 184. In an alternate embodiment, not shown, the first latch unit 180 is disposed substantially, or entirely, within the vacuum housing assembly 50. Further, the rail first portion 134 extends through the first rail passage and the rail second portion 136 extends through the second rail passage.

The second latch unit 190 includes a housing 192, a permanent magnet 194, and a driving coil 196, as described in reference to the first latch unit 180. The second latch unit 190 is disposed on/in the vacuum housing assembly 50 generally opposite the first latch unit 180. The second latch unit housing 192 is disposed about the second rail passage and an outer segment of the rail second portion 136 extends partially into the second latch unit housing 192.

The first latch unit 180 includes a latch device 185 and a release device 187. In an exemplary embodiment, the first latch unit latch device 185 is the first latch unit permanent magnet 184. That is, the first latch unit permanent magnet 184 is structured to, and does, generate a first electromagnetic field (hereinafter, and as used herein, an "EM" field). The first EM field has a sufficient strength to maintain the first armature 146 immediately adjacent the vacuum housing assembly 50 when the movable conductor assembly 100/traveler assembly 142 is in the first position. Stated alternately, when the movable conductor assembly 100/traveler assembly 142 is in the first position, the first armature 146 is disposed effectively within the first EM field. As used herein, a magnetic element is "effectively within an EM field" when the distance between the magnetic element and the source of the EM field is sufficient so that the magnetic element is maintained at a specific location, e.g., adjacent the vacuum housing assembly 50. Thus, the distance required to be "effectively within an EM field" depends upon the strength of the EM field. It is, understood that one EM field is effected by other EM fields; to be "effectively within an EM field" does not mean that the magnetic element is maintained at a specific location at all times. That is, for example, a magnetic element is "effectively within an EM field" if an undisturbed first EM field maintains the magnetic element at a specific location. A second EM field, however, can disrupt the first EM field and allow the magnetic element to move. This does not mean that the magnetic element is not "effectively within [the first] EM field." The first latch unit permanent magnet 184 is structured to, and does, maintain the first armature 146 immediately adjacent the vacuum housing assembly 50 when the movable conductor assembly 100/traveler assembly 142 is in the first position. Thus, the first armature 146 is disposed effectively within said first EM field when the movable conductor assembly 100/traveler assembly 142 is in the first position.

In an exemplary embodiment, the first latch unit driving coil 186 is the first latch unit release device 187. That is, the first latch unit driving coil 186 is structured to, and does, selectively generate an EM field sufficient to negate the first magnet first EM field. That is, the first latch unit release device 187 is a first EM field generator 189 structured to be in one of a non-active state, wherein the first EM field generator 189 does not generate an EM field, and, a second state, wherein the first EM field generator 189 generates an EM field sufficient to negate the first latch unit permanent magnet 184 first EM field.

In this configuration, the first latch unit latch device 185 maintains the movable conductor assembly 100/traveler assembly 142 in the first position, when the first armature 146 is disposed effectively within the first EM field. When the first EM field generator 189 is activated, the first EM field generator 189 generates an EM field sufficient to negate the first magnet first EM field thereby releasing the first armature 146 and therefore the movable conductor assembly 100/traveler assembly 142.

Further, in an exemplary embodiment, the first latch unit release device 187, i.e., the first latch unit driving coil 186/the first EM field generator 189, is further structured to selectively generate a dampening EM field and/or a repulsion EM field. As used herein, a "dampening" EM field is an EM field that weakens, but does not fully disrupt, another EM field. Further, a "dampening" EM field is also a weak repulsion EM field. As used herein, a "repulsion EM" field is an EM field that is structured to, and does, cause a magnetic element to move away from the element generating the repulsion EM field. As shown, the first latch unit release device 187, i.e., the first latch unit driving coil 186/the first EM field generator 189, generates a repulsion EM field sufficient to repel the first armature 146 and therefore the movable conductor assembly 100/traveler assembly 142.

Thus, the first latch unit release device 187, i.e., the first latch unit driving coil 186/the first EM field generator 189, is structured to be in one of a dampening state and/or a repulsion state. When the first EM field generator 189 is in the dampening state, said first EM field generator 189 generates a dampening EM field. In operation, when the movable conductor assembly 100/traveler assembly 142 in moving from the second position to the first position, the dampening EM field slows the movable conductor assembly 100/traveler assembly 142. That is, the dampening EM field repels the first armature 146, and therefore the movable conductor assembly 100/traveler assembly 142, but with a limited force so that the movable conductor assembly 100/traveler assembly 142 moves into the first position, but is slowed.

The first latch unit release device 187, i.e., the first latch unit driving coil 186/the first EM field generator 189 in the repulsion state, creates an EM field sufficient to repel the first armature 146. Thus, the first EM field generator 189 is structured to, and does, move the movable conductor assembly 100/traveler assembly 142 from the first position to the second position. It is understood that the EM field sufficient to repel the first armature 146 is stronger than the first EM field generated by the first latch unit latch device 185/first latch unit permanent magnet 184.

As noted above, the second latch unit 190 is substantially similar to the first latch unit 180 and operates in a similar manner. For example the second latch unit includes a second latch device 195 that is, in an exemplary embodiment, the second latch unit permanent magnet 194. That is, as noted above, the second latch unit 190 includes similar elements wherein the reference number is "+10" relative to the first latch assembly 180. Thus, for example, the second latch unit 190 includes a second latch assembly release device 197. The second latch device 195 has a second EM field. Further, when the movable conductor assembly 100/traveler assembly 142 is in the second position, the second armature 148 is disposed effectively within the second EM field. Further, in a manner similar to the first latch unit 180, the second latch unit driving coil 196 is structured to be selectively disposed in a dampening state and/or a repulsion state. Thus, the second latch unit driving coil 196 is a second EM field generator 199. When the second EM field generator 199 is in the repulsion state, the second EM field generator generates a repulsion EM field sufficient to repel the second armature 148.

The Thomson coil assembly 200 is structured to, and does, move the movable conductor assembly 100/traveler assembly 142 from the second position to the first position. Further, the Thomson coil assembly 200 is structured to, and does, "rapidly" move the movable conductor assembly 100/traveler assembly 142 from the second position to the first position. As used herein, "rapidly" means in less than 5 ms. The Thomson coil assembly 200 includes a generally planar primary coil 202, a generally planar secondary coil/disk 204 and, in an exemplary embodiment, a shield 206. As is known, a Thomson coil assembly primary coil 202 includes a spiral body 210 that is structured to be, and is, coupled to (and in electrical communication with) a selectively actuated current. When the selectively actuated current is energized, the Thomson coil assembly primary coil 202 generates an EM field. The Thomson coil assembly primary coil 202 EM field is stronger than the second EM field. In an exemplary embodiment, the Thomson coil assembly 200 further includes an insulator 212. That is, an insulative material such as, but not limited to, ceramic substantially encloses the Thomson coil assembly primary coil 202. In one exemplary embodiment, the insulator 212 coats the spiral body 210, as shown. In another exemplary embodiment, the insulative material forms two sheets with one sheet disposed axially above the spiral body 210 and the other sheet disposed below the spiral body 210. In an exemplary embodiment, the insulative material sheets have a non-planar surface, e.g., a wave surface.

The Thomson coil assembly secondary coil/disk 204 is structured to, and does, react to the Thomson coil assembly primary coil 202 EM field. That is, the Thomson coil assembly secondary coil/disk 204 is structured to, and does, move between a first position, wherein the Thomson coil assembly secondary coil/disk 204 is spaced from the Thomson coil assembly primary coil 202, and a second position, wherein the secondary coil/disk 204 is adjacent, or immediately adjacent, the Thomson coil assembly primary coil 202. In an exemplary embodiment, there is a small gap between the Thomson coil assembly secondary coil/disk 204 and the Thomson coil assembly primary coil 202 when the Thomson coil assembly secondary coil/disk 204 is in the second position. It is understood that a "small gap" is relative to the size of the components and, as such, no specific measurements are provided. As used herein, separation by a "small gap" does not means that the Thomson coil assembly secondary coil/disk 204 and the Thomson coil assembly primary coil 202 are "spaced" from each other as when the Thomson coil assembly secondary coil/disk 204 and the Thomson coil assembly primary coil 202 are in the first position. Stated alternately, and as described in more detail below, when the Thomson coil assembly secondary coil/disk 204 and the Thomson coil assembly primary coil 202 are in the second position, the movable conductor assembly 100 is in the second position and the movable contacts 102, 104 are in electrical communication with the stationary conductor assemblies 80, 90 regardless of the "small gap." Conversely, when the Thomson coil assembly secondary coil/disk 204 and the Thomson coil assembly primary coil 202 are in the first position, the movable conductor assembly 100 is in the first position and the movable contacts 102, 104 are not in electrical communication with the stationary conductor assemblies 80, 90.

The Thomson coil assembly primary coil 202 is structured to, and does, move the Thomson coil assembly secondary coil/disk 204 from the second position to the first position. That is, when the Thomson coil assembly secondary coil/disk 204 is in the second position, and, when the Thomson coil assembly primary coil 202 is energized, the Thomson coil assembly primary coil 202 EM field is generated and repels the Thomson coil assembly secondary coil/disk 204 thereby moving the Thomson coil assembly secondary coil/disk 204 to the first position. Stated alternately, the Thomson coil assembly 200 is structured to be in one of a de-energized state, wherein the Thomson coil primary coil 202 does not repel the Thomson coil secondary coil/disk 204, and an energized state, wherein the Thomson coil primary coil 202 repels the Thomson coil secondary coil/disk 204. It is understood that the Thomson coil assembly 200 is generally in the de-energized state until it receives a command from the control unit or a trip unit. That is, the Thomson coil assembly 200 is structured to, and does, switch states upon a command from the control unit or a trip unit.

The Thomson coil shield 206 includes a generally cup shaped, or a generally hollow cylindrical, body 208. The Thomson coil shield 206, in an exemplary embodiment, is coupled to the contact assembly chamber 56. The Thomson coil shield body 208 is disposed about the Thomson coil assembly primary coil 202 and the Thomson coil assembly secondary coil/disk 204. The Thomson coil shield 206 defines a generally enclosed space for the Thomson coil assembly primary coil 202 and the Thomson coil assembly secondary coil/disk 204.

In an alternate embodiment, the vacuum chamber contact assembly 40 also includes a first shield 89 and a second shield 99 (both shown in ghost) disposed about the first stationary conductor assembly 80 and the second stationary conductor assembly 90, respectively. The vacuum chamber contact assembly shields 89, 99 are substantially similar to the Thomson coil shield 206 described above. It is understood that the vacuum chamber contact assembly first shield 89 is disposed about the first stationary conductor assembly 80 and the vacuum chamber contact assembly second shield 99 is disposed about the second stationary conductor assembly 90. Further, in an exemplary embodiment (not shown), the distal perimeters of the vacuum chamber contact assembly first and second shields 89, 99 are angled so as to accommodate the motion of the movable conductor assembly 100. That is, the vacuum chamber contact assembly first and second shields 89, 99 are not disposed in the path of the movable conductor assembly 100.

The Thomson coil assembly primary coil 202 is coupled, directly coupled, or fixed to the inner surface of the vacuum housing assembly 50 and is disposed about the rail 132 and, in an exemplary embodiment, about the rail second portion 136. The Thomson coil assembly secondary coil/disk 204 is coupled, directly coupled, or fixed to the traveler assembly body assembly 144. In an exemplary embodiment, the Thomson coil assembly secondary coil/disk 204 is disposed between the traveler body first portion 152 and traveler body second portion 154 and is coupled, directly coupled, or fixed to both.

The vacuum chamber contact assembly 40 is configured as follows. The rail first portion 134 is passed through the first rail passage with the inner segment of rail first portion 134 extending into the vacuum housing assembly enclosed space 52. The outer segment of rail first portion 134 extends outwardly from, and generally perpendicular to, the outer surface of the vacuum housing assembly 50. The rail second portion 136 is passed through the second rail passage with an inner segment of rail second portion 136 extending into the vacuum housing assembly enclosed space 52. The outer segment of second portion 136 extends outwardly from, and generally perpendicular to, the outer surface of the vacuum housing assembly 50. The Thomson coil assembly primary coil 202 is coupled to the inner surface of the vacuum housing assembly 50 and is disposed about the rail first portion 134.

The traveler assembly 142 is coupled, directly coupled, or fixed to the crossbar 106. That is, the crossbar 106 is disposed between the traveler assembly body assembly first portion 152 and second portion 154. The Thomson coil assembly secondary coil/disk 204 is coupled, directly coupled, or fixed to the distal surface of the traveler assembly body assembly first end 162. The Thomson coil assembly primary coil 202 and the Thomson coil assembly secondary coil/disk 204 are oriented so that the planar surfaces are substantially parallel. The traveler assembly body assembly 144 is movably disposed on the rail 132. That is, the rail first portion 134 is disposed within the traveler body passage 160 which is part of the traveler body first portion 152, and, the rail second portion 136 is disposed in the traveler body passage 160 which is part of the traveler body second portion 154. In this configuration, the conductor assembly 100/traveler assembly 142 is movably coupled to the vacuum housing assembly 50. That is, as shown in the figures, the rail first and second portions 134, 136 have a length that is limited so that the traveler assembly body assembly 144 is able to move toward/away from each the rail first and second portion 134, 136.

The first stationary conductor assembly 80 is partially disposed in the vacuum housing assembly 50. That is, the first stem body 88 extends through the first stem chamber end cap 66 and the first stem chamber 58 and into the contact assembly chamber 56. The first stationary contact 82 is disposed in the contact assembly chamber 56. The distal end of the first stem body 88 extends to the outer side of the first stem chamber end cap 66. The second stem body 98 is mounted in a similar manner in the second stem chamber 60. The first and second stem bodies 88, 98 are sealingly coupled, and in an exemplary embodiment, brazed, to the first and second end cap 66, 68, respectively. Similarly, the rail 132 is sealingly coupled, and in an exemplary embodiment, brazed, to the vacuum housing assembly 50. Further, the exposed distal ends of the first and second stem bodies 88, 98 are coupled to, and are in electrical communication with, the first terminal 22 and the second terminal 24, respectively.

It is understood that the rail 132 is disposed generally between the first and second stationary contacts 82, 92. Further, the noncircular rail 132 is oriented so that the traveler assembly 142/crossbar 106 are oriented to position the first and second movable contacts 102, 104 in line with the first and second stationary contacts 82, 92. Further, in this configuration, the first latch unit 180 is disposed on the outer surface of the vacuum housing assembly 50 at a first end of the operating mechanism number of movable components' 140 path of travel. Similarly, the second latch unit 190 is disposed on the outer surface of the vacuum housing assembly 50 at a second end of the operating mechanism number of movable components' 140 path of travel. It is understood that, and as used herein, "at a [first/second] end of the operating mechanism number of movable components 140 path of travel" means that the moving element (in this example the "operating mechanism number of movable components 140") has a path of travel that is not a loop and, therefore, has a first/second end. That is, an "end" to a path of travel is where the moving element reverses direction of movement on the "path of travel."

When assembled, as described above, the vacuum chamber contact assembly 40 does not include a slider assembly, a braided wire or similar constructs within the vacuum housing assembly 50. This solves the problem(s) noted above.

The vacuum chamber contact assembly 40 operates as follows. For this description, the movable conductor assembly 100/traveler assembly 142/Thomson coil assembly secondary coil/disk 204 is initially in the second position. That is, the vacuum chamber contact assembly 40 is in a closed, second configuration. In this configuration, the second latch unit 190 maintains the movable conductor assembly 100 in the second position. That is, second armature 148 is disposed effectively within the second EM field generated by the second latch unit permanent magnet 194. As a permanent magnet such as, but not limited to, second latch unit permanent magnet 194 is not energized, that is, the second EM field is naturally generated, there is no need to have an element of the operating mechanism 120 always energized so as to maintain the movable conductor assembly 100 in the second position. This solves the problem(s) noted above.

Upon a command from the control unit or a trip unit, the Thomson coil assembly 200 is energized. This causes the Thomson coil assembly secondary coil/disk 204 to move to the first position (rapidly). As the Thomson coil assembly secondary coil/disk 204 is coupled, directly coupled, or fixed to the traveler assembly 142, and therefore the movable conductor assembly 100 too, the traveler assembly 142/movable conductor assembly 100 also move to their first positions. That is, energizing the Thomson coil assembly 200 causes the movable contacts 102, 104 to move from the second position to the first position.

In an exemplary embodiment, as the Thomson coil assembly 200 is energized, the first latch unit driving coil 186/the first EM field generator 189 generates a dampening EM field. The existence of the dampening EM field slows the velocity of the movable conductor assembly 100/traveler assembly 142. This prevents the movable conductor assembly 100/traveler assembly 142 from making full speed contact with the vacuum housing assembly 50. This solves the problem(s) noted above.

Once the conductor assembly 100/traveler assembly 142 is in the first position, the first armature 146 is immediately adjacent the vacuum housing assembly 50 and is disposed effectively within the first EM field. That is, the first latch unit permanent magnet 184 maintains the first armature 146 immediately adjacent the vacuum housing assembly 50 when the movable conductor assembly 100/traveler assembly 142 is in the first position. Thus, the conductor assembly 100/traveler assembly 142 is maintained in the first position without an element of the operating mechanism 120 always energized. This solves the problem(s) noted above.

Further, in one embodiment, not shown, the operating mechanism 120 includes mechanical elements structured to move the movable conductor assembly 100/traveler assembly 142 from the first position to the second position. To reduce the force needed for the mechanical elements to move the movable conductor assembly 100/traveler assembly 142, the first EM field generator 189 generates an EM field sufficient to negate the first latch unit permanent magnet 184 first EM field. In the embodiment shown, the first EM field generator 189 generates a repulsion EM field sufficient to repel the first armature 146 and therefore the movable conductor assembly 100/traveler assembly 142. That is, the first EM field generator 189 causes the movable conductor assembly 100/traveler assembly 142 to move from the first position to the second position.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A vacuum chamber contact assembly for a circuit breaker, said circuit breaker including a housing assembly, said vacuum chamber contact assembly comprising:

a vacuum housing assembly defining a sealed enclosed space;

a conductor assembly including a first stationary conductor assembly, a second stationary conductor assembly, and a movable conductor assembly;

an operating mechanism including a number of stationary components, a number of movable components and an actuator/latch assembly;

wherein said movable conductor assembly and said operating mechanism movable components are disposed entirely within said vacuum housing assembly enclosed space;

wherein said actuator/latch assembly includes an open, first latch unit and a close, second latch unit;

said movable conductor assembly moves between an open, first position, wherein said movable conductor assembly is spaced from, and is not in electrical communication with said first stationary conductor assembly and said second stationary conductor assembly, and, a second position, wherein said movable conductor assembly is coupled to, and is in electrical communication with said first stationary conductor assembly and said second stationary conductor assembly; and wherein said actuator/latch assembly is structured to maintain said movable conductor assembly in both said first position and said second position.

2. The vacuum chamber contact assembly of claim 1 wherein:

said first latch unit is disposed on the outer surface of said vacuum housing assembly at a first end of said operating mechanism number of movable components path of travel; and said second latch unit is disposed on the outer surface of said vacuum housing assembly at a second end of said operating mechanism number of movable components path of travel.

3. The vacuum chamber contact assembly of claim 2 wherein:

said first latch unit disposed entirely on the outer surface of said vacuum housing assembly; and said second latch unit disposed entirely on the outer surface of said vacuum housing assembly.

4. The vacuum chamber contact assembly of claim 2 wherein:

said first latch unit includes a latch device and a release device; and said second latch unit includes a latch device and a release device.

5. The vacuum chamber contact assembly of claim 4 wherein:

said first latch device is a permanent first magnet having a first EM field;

said first release device is a first EM field generator structured to be in one of a non-active state, wherein said first EM field generator does not generate an EM field, and, a second state, wherein said first EM field generator generates an EM field sufficient to negate said first magnet first EM field;

said second latch device is a permanent second magnet having a second EM field; and said second release device is a second EM field generator structured to be in one of a non-active state, wherein said second EM field generator does not generate an EM field, and, a second state, wherein said second EM field generator generates an EM field sufficient to negate said second magnet first EM field.

6. The vacuum chamber contact assembly of claim 1 wherein:

said operating mechanism number of stationary components including a rail;

said operating mechanism number of movable components including a traveler assembly;

said traveler assembly movably disposed on said rail and structured to travel between a first position and a second position;

said first stationary conductor assembly including a stationary contact;

said second stationary conductor assembly includes a stationary contact;

said movable conductor assembly including a first movable contact and a second movable contact;

said first stationary contact and said second stationary contact coupled to said vacuum housing assembly;

said first movable contact and said second movable contact coupled to said traveler assembly;

wherein said first movable contact moves between an open, first position, wherein said movable first movable contact is not coupled to, and is not in electrical communication with said first stationary contact, and, a second position, wherein said first movable contact is coupled to, and is in electrical communication with said first stationary contact; and wherein said second movable contact moves between an open, first position, wherein said movable second movable contact is not coupled to, and is not in electrical communication with said second stationary contact, and, a second position, wherein said second movable contact is coupled to, and is in electrical communication with said second stationary contact.

7. The vacuum chamber contact assembly of claim 6 wherein:

said rail has a non-circular cross-section;

said traveler assembly includes a body assembly, a first armature, and a second armature;

said traveler assembly body assembly defining a passage corresponding to said rail non-circular cross-section, said traveler assembly body assembly having a first end, a medial portion, and a second end;

said first armature coupled to said traveler assembly body assembly first end;

said second armature coupled to said traveler assembly body assembly second end;

said movable conductor assembly including a crossbar; and said movable conductor assembly crossbar coupled to said traveler assembly body assembly medial portion.

8. The vacuum chamber contact assembly of claim 7 wherein:

said actuator/latch assembly including a Thomson coil assembly having a primary coil and a secondary coil/disk;

said Thomson coil primary coil coupled to the inner surface of said vacuum housing assembly and disposed about said rail;

said Thomson coil secondary coil/disk coupled to said traveler assembly body assembly; and wherein said Thomson coil assembly is structured to be in one of a de-energized state, wherein said Thomson coil primary coil does not repel said Thomson coil secondary coil/disk, and an energized state, wherein said Thomson coil primary coil repels said Thomson coil secondary coil/disk.

9. The vacuum chamber contact assembly of claim 8 wherein:

said first latch unit is disposed on the outer surface of said vacuum housing assembly at a first end of said operating mechanism number of movable components path of travel; and said second latch unit is disposed on the outer surface of said vacuum housing assembly at a second end of said operating mechanism number of movable components path of travel;

said first latch unit includes a latch device and a release device;

said second latch unit includes a latch device and a release device;

said first latch device is a permanent first magnet having a first EM field;

said first release device is a first EM field generator structured to be in one of a non-active state, wherein said first EM field generator does not generate an EM field, and, a second state, wherein said first EM field generator generates an EM field sufficient to negate said first magnet first EM field;

said second latch device is a permanent second magnet having a second EM field;

said second release device is a second EM field generator structured to be in one of a non-active state, wherein said second EM field generator does not generate an EM field, and, a second state, wherein said second EM field generator generates an EM field sufficient to negate said second magnet first EM field;

wherein, when said traveler assembly is in said first position, said first armature is disposed effectively within said first EM field; and wherein, when said traveler assembly is in said second position, said second armature is disposed effectively within said second EM field.

10. The vacuum chamber contact assembly of claim 9 wherein:

said first EM field generator is further structured to be in one of a dampening state or a repulsion state;

wherein, when said first EM field generator is in said dampening state, said first EM field generator generates a dampening EM field;

wherein, when said first EM field generator is in said repulsion state, said first EM field generator generates a repulsion EM field sufficient to repel said first armature;

said second EM field generator is further structured to be in a repulsion state;

wherein, when said second EM field generator is in said repulsion state, said second EM field generator generates a repulsion EM field sufficient to repel said second armature.

11. A vacuum circuit breaker comprising:

a housing assembly;

a vacuum chamber contact assembly coupled to said housing assembly;

said vacuum chamber contact assembly including a vacuum housing assembly, a conductor assembly, and an operating mechanism;

said vacuum housing assembly defining a sealed enclosed space;

said conductor assembly including a first stationary conductor assembly, a second stationary conductor assembly, and a movable conductor assembly;

said operating mechanism including a number of stationary components, a number of movable components and an actuator/latch assembly;

wherein said movable conductor assembly and said operating mechanism movable components are disposed entirely within said vacuum housing assembly enclosed space;

wherein said actuator/latch assembly includes an open, first latch unit and a close, second latch unit;

said movable conductor assembly moves between an open, first position, wherein said movable conductor assembly is spaced from, and is not in electrical communication with said first stationary conductor assembly and said second stationary conductor assembly, and, a second position, wherein said movable conductor assembly is coupled to, and is in electrical communication with said first stationary conductor assembly and said second stationary conductor assembly; and wherein said actuator/latch assembly is structured to maintain said movable conductor assembly in both said first position and said second position.

12. The vacuum circuit breaker of claim 11 wherein:

said first latch unit is disposed on the outer surface of said vacuum housing assembly at a first end of said operating mechanism number of movable components path of travel; and said second latch unit is disposed on the outer surface of said vacuum housing assembly at a second end of said operating mechanism number of movable components path of travel.

13. The vacuum circuit breaker of claim 12 wherein:

said first latch unit disposed entirely on the outer surface of said vacuum housing assembly; and said second latch unit disposed entirely on the outer surface of said vacuum housing assembly.

14. The vacuum circuit breaker of claim 12 wherein:

said first latch unit includes a latch device and a release device; and said first second unit includes a latch device and a release device.

15. The vacuum circuit breaker of claim 14 wherein:

said first latch device is a permanent first magnet having a first EM field;

said first release device is a first EM field generator structured to be in one of a non-active state, wherein said first EM field generator does not generate an EM field, and, a second state, wherein said first EM field generator generates an EM field sufficient to negate said first magnet first EM field;

said second latch device is a permanent second magnet having a second EM field; and said second release device is a second EM field generator structured to be in one of a non-active state, wherein said second EM field generator does not generate an EM field, and, a second state, wherein said second EM field generator generates an EM field sufficient to negate said second magnet first EM field.

16. The vacuum circuit breaker of claim 11 wherein:

said operating mechanism number of stationary components including a rail;

said operating mechanism number of movable components including a traveler assembly;

said traveler assembly movably disposed on said rail and structured to travel between a first position and a second position;

said first stationary conductor assembly including a stationary contact;

said second stationary conductor assembly includes a stationary contact;

said movable conductor assembly including a first movable contact and a second movable contact;

said first stationary contact and said second stationary contact coupled to said vacuum housing assembly;

said first movable contact and said second movable contact coupled to said traveler assembly;

wherein said first movable contact moves between an open, first position, wherein said movable first movable contact is not coupled to, and is not in electrical communication with said first stationary contact, and, a second position, wherein said first movable contact is coupled to, and is in electrical communication with said first stationary contact; and wherein said second movable contact moves between an open, first position, wherein said second movable contact is not coupled to, and is not in electrical communication with said second stationary contact, and, a second position, wherein said second movable contact is coupled to, and is in electrical communication with said second stationary contact.

17. The vacuum circuit breaker of claim 16 wherein:

said rail has a non-circular cross-section;

said traveler assembly includes a body assembly, a first armature, and a second armature;

said traveler assembly body assembly defining a passage corresponding to said rail non-circular cross-section, said traveler assembly body assembly having a first end, a medial portion, and a second end;

said first armature coupled to said traveler assembly body assembly first end;

said second armature coupled to said traveler assembly body assembly second end;

said movable conductor assembly including a crossbar; and said movable conductor assembly crossbar coupled to said traveler assembly body assembly medial portion.

18. The vacuum circuit breaker of claim 17 wherein:

said actuator/latch assembly including a Thomson coil assembly having a primary coil and a secondary coil/disk;

said Thomson coil primary coil coupled to the inner surface of said vacuum housing assembly and disposed about said rail;

said Thomson coil secondary coil/disk coupled to said traveler assembly body assembly; and wherein said Thomson coil assembly is structured to be in one of a de-energized state, wherein said Thomson coil primary coil does not repel said Thomson coil secondary coil/disk, and an energized state, wherein said Thomson coil primary coil repels said Thomson coil secondary coil/disk.

19. The vacuum circuit breaker of claim 18 wherein:

said first latch unit is disposed on the outer surface of said vacuum housing assembly at a first end of said operating mechanism number of movable components path of travel; and said second latch unit is disposed on the outer surface of said vacuum housing assembly at a second end of said operating mechanism number of movable components path of travel;

said first latch unit includes a latch device and a release device;

said second latch unit includes a latch device and a release device;

said first latch device is a permanent first magnet having a first EM field;

said first release device is a first EM field generator structured to be in one of a non-active state, wherein said first EM field generator does not generate an EM field, and, a second state, wherein said first EM field generator generates an EM field sufficient to negate said first magnet first EM field;

said second latch device is a permanent second magnet having a second EM field;

said second release device is a second EM field generator structured to be in one of a non-active state, wherein said second EM field generator does not generate an EM field, and, a second state, wherein said second EM field generator generates an EM field sufficient to negate said second magnet first EM field;

wherein, when said traveler assembly is in said first position, said first armature is disposed effectively within said first EM field; and wherein, when said traveler assembly is in said second position, said second armature is disposed effectively within said second EM field.

20. The vacuum circuit breaker of claim 19 wherein:

said first EM field generator is further structured to be in one of a dampening state or a repulsion state;

wherein, when said first EM field generator is in said dampening state, said first EM field generator generates a dampening EM field;

wherein, when said first EM field generator is in said repulsion state, said first EM field generator generates a repulsion EM field sufficient to repel said first armature;

said second EM field generator is further structured to be in a repulsion state; and wherein, when said second EM field generator is in said repulsion state, said second EM field generator generates a repulsion EM field sufficient to repel said second armature.

* * * * *